US006174211B1

(12) United States Patent
Nakamura

(10) Patent No.: US 6,174,211 B1
(45) Date of Patent: Jan. 16, 2001

(54) TILLER LOCK FOR OUTBOARD MOTOR

(75) Inventor: Daisuke Nakamura, Hamamatsu (JP)

(73) Assignee: SanShin Kogyo Kabushiki Kaisha (JP)

( * ) Notice: Under 35 U.S.C. 154(b), the term of this patent shall be extended for 0 days.

(21) Appl. No.: 09/368,974

(22) Filed: Aug. 5, 1999

Related U.S. Application Data

(63) Continuation-in-part of application No. 09/087,573, filed on May 29, 1998.

(30) Foreign Application Priority Data

Aug. 5, 1998 (JP) ..... 10-221260

(51) Int. Cl.[7] ..... B63H 20/08
(52) U.S. Cl. ..... 440/55; 114/172
(58) Field of Search ..... 440/55, 56; 114/170, 114/172

(56) References Cited

U.S. PATENT DOCUMENTS 4,521,201 6/1985 Watanabe ..... 440/55
4,701,141 10/1987 Sumigawa ..... 440/55
5,582,527 12/1996 Nakamura ..... 440/55

*Primary Examiner*—Jesus D. Sotelo
(74) *Attorney, Agent, or Firm*—Knobbe, Martens, Olson & Bear, LLP

(57) ABSTRACT

An outboard motor has a tiller lock which retains the rotational orientation of the outboard motor relative to a watercraft. The tiller lock allows the motor to be pivoted about a substantially horizontal tilt and trim axis while the tiller lock is engaged. The tiller lock includes a friction track advantageously arranged rearward of the tilt and trim axis. The positioning of the friction track protects the it from damage due to inadvertent contact with other components of the outboard motor mounting assembly. In particular, the friction track is protected throughout a full range of motion of the outboard motor. In addition, a pair of opposing brake members are alternately engageable with the friction track to secure the motor in a desired orientation. A bi-directional actuator handle urges either of the brake members into the friction plate independent of the other brake member to create a locking drag force which accompanies a substantially normal compressive force.

32 Claims, 11 Drawing Sheets

TILLER LOCK FOR OUTBOARD MOTOR

CROSS-REFERENCE TO RELATED APPLICATION

This application is a continuation-in-part of copending application Ser. No. 09/087,573, filed May 29, 1998.

BACKGROUND OF THE INVENTION

1. Field of the Invention

The present invention generally relates to a steering device for outboard motors. In particular, the present invention relates to a device for mechanically retaining an outboard motor in a desired angular orientation relative to a watercraft while permitting pivotal movement of the outboard motor about a tilt and trim axis.

2. Description of Related Art

As is well-known in the art, an outboard motor typically includes a clamping bracket which secures the outboard motor to a transom of a watercraft. A swivel bracket is pivotally secured to the clamping bracket so as to allow both steering movement of the motor about a steering axis and trimming and tilting movement of the motor about a tilt and trim axis. The trimming movement relative to the watercraft transom is often required to adjust the angular orientation of a thrust vector associated with a propeller. In particular, by adjusting the trim position of the outboard motor, an optimum orientation of the thrust vector can be obtained.

A tiller or handle is attached to the outboard motor to facilitate steering movement. In many instances, it is desirable to mechanically maintain a predetermined tack of the watercraft so that the operator is not required to continually have a hand on the tiller. For example, when the operator is trolling for fish, he or she may want to keep both hands free while the watercraft continues a straight-ahead or circular tack. Similarly, when traveling in a straight line across a current, it is necessary to position the motor to steer slightly into the current to compensate for the forces of the current that tend to turn or propel the watercraft in an undesired direction. Thus, it is desired to have a tiller position-locking device that is capable of maintaining the steering components in any of a continuous array of positions.

SUMMARY OF THE INVENTION

Previous restraining devices have had a guide plate which defines a range of locking positions. The guide plate provides a location upon which a friction member can lock to secure an outboard motor in a desired position relative to a watercraft. Structurally, the guide plate extends forward of the tilt and trim axis. Consequently, when the propeller end of the outboard motor are pivoted upward, out of the water, about the tilt and trim axis, the guide plate strikes a component of the watercraft or outboard motor which was located near the transom of the watercraft, such as a transom screw of a clamping bracket. Thus, the guide plate is often bent when the propeller end of the outboard motor was pivoted out of the water for storage or servicing. Accordingly, one aspect of the present invention involves the recognition that reducing or eliminating the exposure of the guide plate forward of the tilt and trim axis can prevent possible damage to the guide plate.

Another aspect of the present invention involves an outboard motor comprising a clamping bracket adapted to be attached to a watercraft. A pin connects a swivel bracket to the clamping bracket. The swivel bracket is pivotally attached to allow a tilting or trimming movement relative to the clamping bracket about a substantially horizontal tilt and trim axis. The swivel bracket also enables steering movement of the outboard motor relative to the watercraft about a steering axis that is substantially normal to the tilt and trim axis. A tiller is attached to the outboard motor to facilitate the steering movement. The tiller extends forward of the steering axis and includes a tiller locking device. The tiller locking device is attached to the swivel bracket and the tiller and is arranged at least partially rearward of the pin.

A further aspect of the present invention involves an outboard motor mounting assembly comprising a swivel bracket pivotally attached to a clamping bracket by a pin. The swivel bracket is rotatable relative to the clamping bracket about a substantially horizontal tilt and trim axis. A steering shaft is journalled by the swivel bracket for movement of the steering shaft about a steering axis which is substantially normal to the tilt and trim axis. A tiller arm is connected to the steering shaft for controlling the movement of the steering shaft. The assembly also includes a locking mechanism which is operable between the swivel bracket and steering shaft so as to selectively maintain the position of the steering shaft relative to the swivel bracket. The locking mechanism is arranged to lie at least partially rearward of a substantially vertical plane defined through the pin.

Another aspect of the present invention involves an outboard motor comprising a powerhead connected by a driveshaft housing to a propulsion unit. The driveshaft housing is connected to a steering shaft. The steering shaft is journalled by a swivel bracket for rotational movement. The swivel bracket is attached to a clamping bracket which has a transom screw. The swivel bracket is able to be pivoted relative to the clamping bracket about a substantially horizontal tilt and trim axis. A locking mechanism is operable between the swivel bracket and a tiller for securing the relative position between the swivel bracket and the tiller. The locking mechanism has a friction track interposed between at least two braking members which are alternately engageable with the friction track.

BRIEF DESCRIPTION OF THE DRAWINGS

These and other features, aspects and advantages of the present invention will now be described with reference to the drawings of several preferred embodiments, which embodiment intended to illustrate and not to limit the present invention, and in which.

DETAILED DESCRIPTION OF A PREFERRED EMBODIMENT OF THE PRESENT INVENTION

Figure 1:
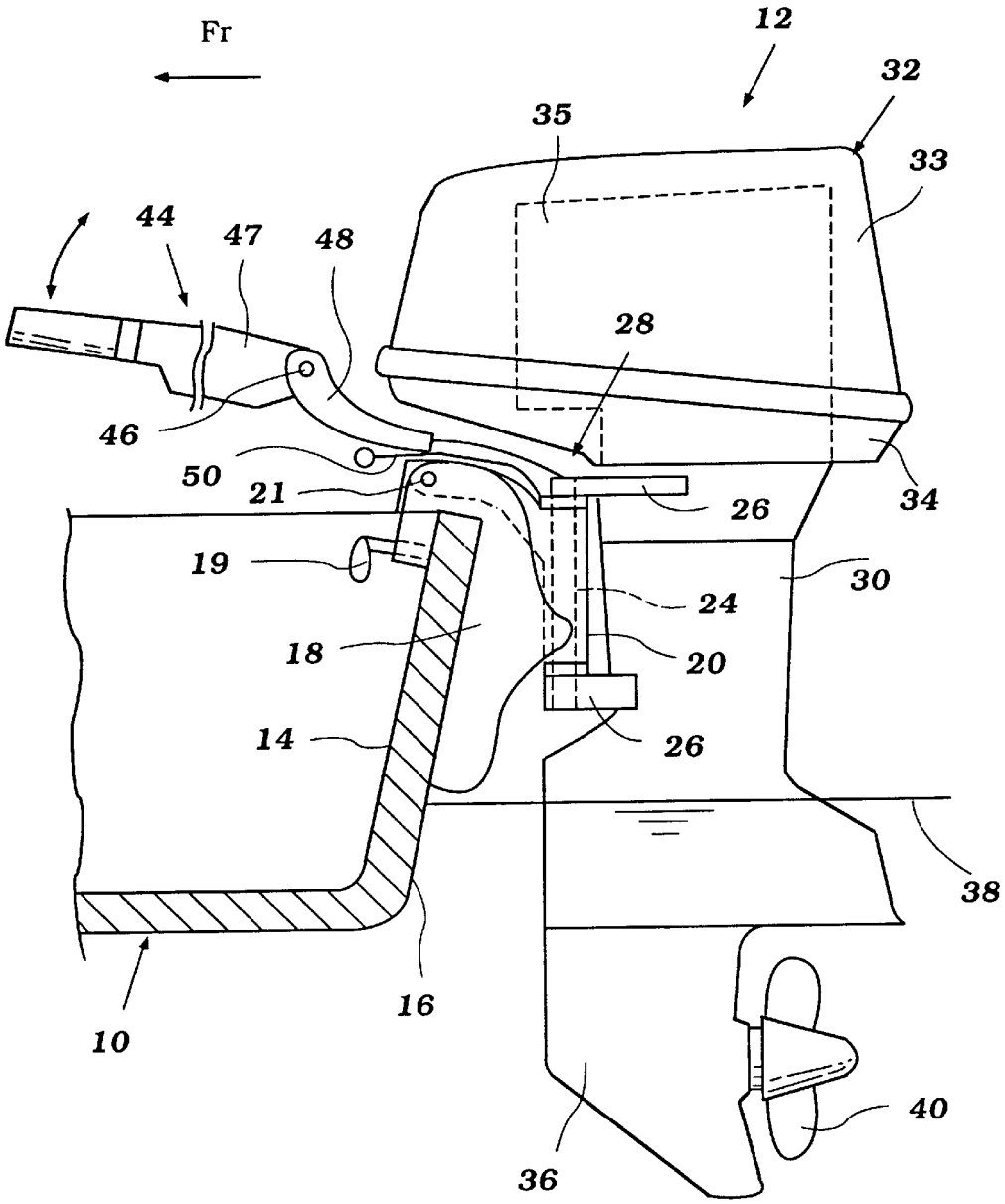
FIG. 1 is a partially sectioned side elevational view of a watercraft having an outboard motor with a swivel bracket and a tiller lock constructed in accordance with an embodiment of the present invention.
Figure 2:
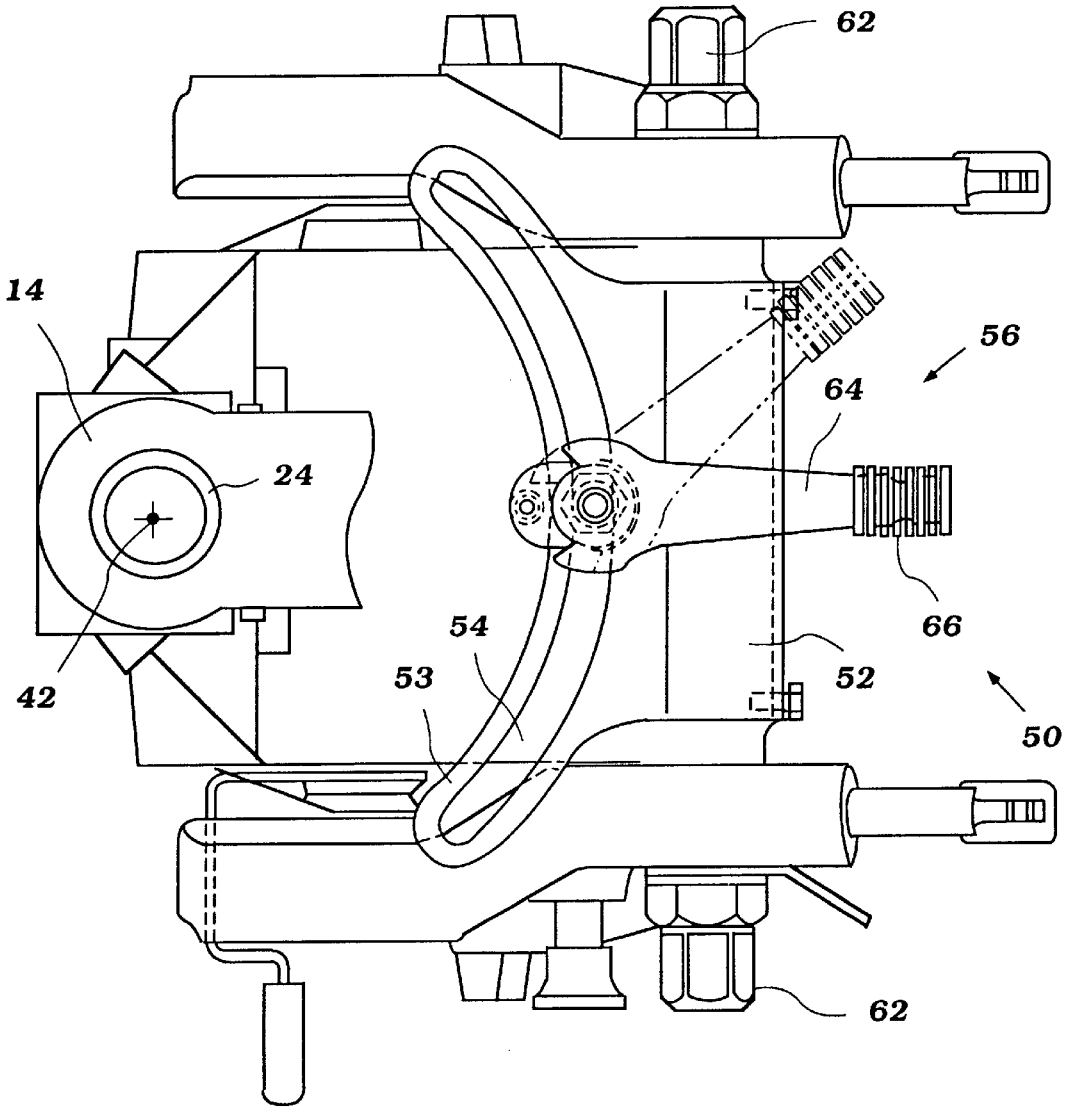
FIG. 2 is a partial top plan view of the swivel bracket and the tiller lock of FIG. 1.

With reference to FIGS. 1 and 2, a watercraft 10 and an outboard motor 12 are illustrated having an outboard motor mounting arrangement constructed in accordance with an embodiment of the present invention. As illustrated in FIG. 1, the watercraft is adapted to move through a body of water generally in the direction indicated by the arrow and the reference letters Fr. Accordingly, the motor 12 is adapted to be attached to the stem 14 of the watercraft 10, and particularly to the watercraft transom 16. For this purpose, a clamping bracket assembly 18, which may include a transom screw 19, is provided to attach the motor 12 to the transom 16.

A substantially horizontal pin 21 secures a swivel bracket 20 to the clamping bracket 18 for pivotal movement. The center of pin 21 thereby defines a tilt and trim axis 22 (as seen in FIG. 2) about which the motor 12 may be tilted upward for storage, tilted downward for use, or trimmed slightly in or out to adjust the thrust vector associated with the motor 12. As will be recognized by one of skill in the art, an outboard motor is typically tilted to move the motor between storage or use positions and when the watercraft is removed from the water for transportation on a trailer. The ends of the pin 21 may be secured in place by a pair of nuts 62.

With reference again to FIG. 1, the swivel bracket 20 journals a steering shaft 24 that is attached to a housing of the motor 12 in any suitable manner. In the illustrated watercraft, a pair of brackets 26 attach the steering shaft 24 to a drive shaft housing 30 of the motor 12. A steering bracket 28 is secured to the swivel bracket 20 in any suitable manner.

As also illustrated in FIG. 1, an upper end of the drive shaft housing 30 carries a power head 32 that includes an upper cowling portion 33 and a lower tray portion 34. The power head 32 also contains an internal combustion engine 35. Depending from the drive shaft housing 30 is a lower unit 36 which is desirably positioned below the waterline 38 during use. A propeller 40 is mounted to the lower unit 36 by a shaft (not shown) that is journalled for rotation within the lower unit 36. The propeller 40 is rotatably driven in any suitable manner by the internal combustion engine 35.

With reference to FIG. 2, the steering shaft 24 rotates about a steering axis 42 for steering movement of the motor 12. The steering axis 42 is preferably substantially normal to the tilt and trim axis 22 and is generally defined by a centerline of the steering shaft 24. A tiller 44 facilitates steering movement of the outboard motor 12 about the steering axis 42. The motor 12 is able to be rotated through a generally continuous array of steering positions. Thus, to steer the watercraft, the tiller 44 is used to rotate the motor 12 about the steering axis 42 defined by the centerline of the steering shaft 24 to a desired position within the available array of positions.

The tiller 44, as clearly shown in FIG. 1, has a generally forward extending handle 47. The handle 47 desirably has a throttle-control portion. In the illustrated watercraft, the handle is pivotally mounted by a threaded fastener 46 to a generally upwardly arc-shaped member 48 which forms the base portion of the tiller 44. The generally arc-shaped member 48 contains a blocking portion (not shown) to prevent downward vertical pivoting of the handle 47 relative to the arc-shaped member 48.

In accordance with an aspect of the present invention, a tiller locking device 50 is provided for maintaining the motor 12 in any of the plurality of steering positions which may be selected by the operator. The tiller locking device 50 also allows the outboard motor 12 to be trimmed or tilted about the tilt and trim axis 22 while the tiller locking device 50 maintains the motor 12 in the selected steering position. As normally employed, the tiller locking device 50 will releasably maintain the motor 12 in any of a plurality of steering positions such that the associated watercraft 10 is propelled along a predetermined and mechanically maintained tack, such as, a straight line or a predetermined turning radius.

As shown in FIGS. 2 through 5, the tiller locking device 50 includes a flange 52 having a friction track 53. In the illustrated embodiment, the friction track 53 has an arcuate shape and includes an arcuate slot 54 extending with a generally constant radius originating at or near the steering axis 42. Of course, other shapes of the friction track 53 are also possible. The friction track 53 can be textured, surfaced treated or otherwise roughened to create a plate which can be frictionally engaged by a drag adjustment mechanism, generally identified by numeral 56 and described in detail below.

Figure 4:
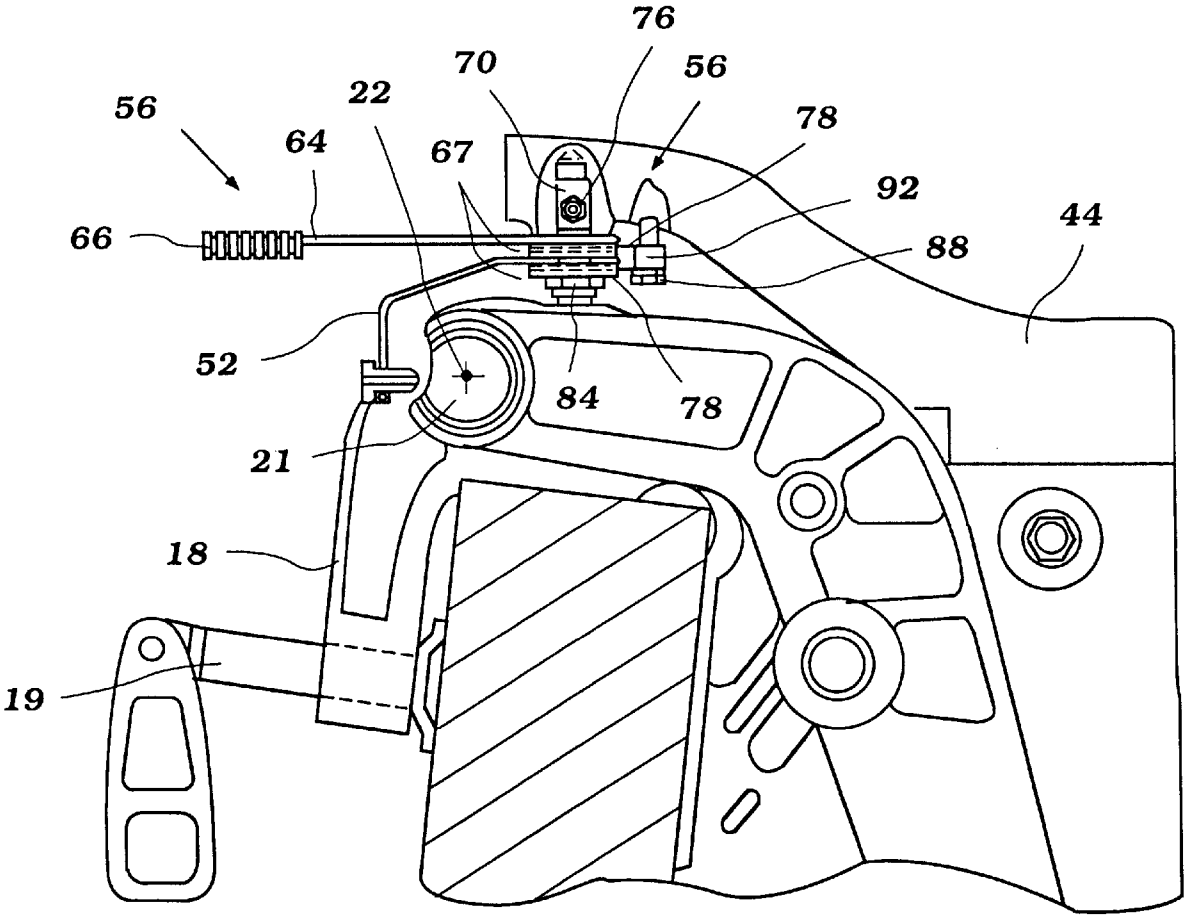
FIG. 4 is a partial sectioned side view of the swivel bracket and the tiller lock of FIG. 3 taken through the line 4—4.
Figure 5:
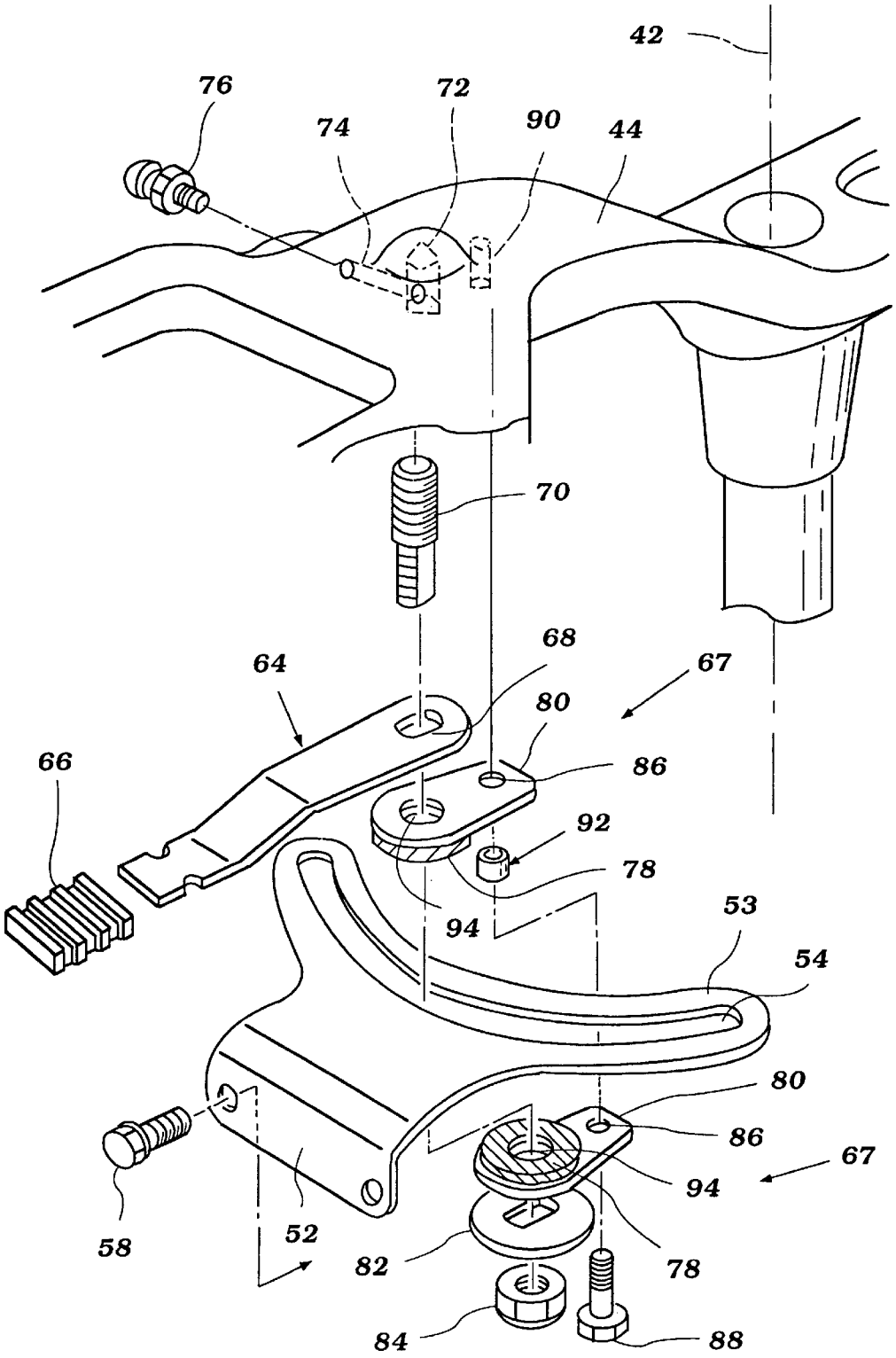
FIG. 5 is an exploded perspective view of the tiller lock of FIG. 1.
Figure 6:
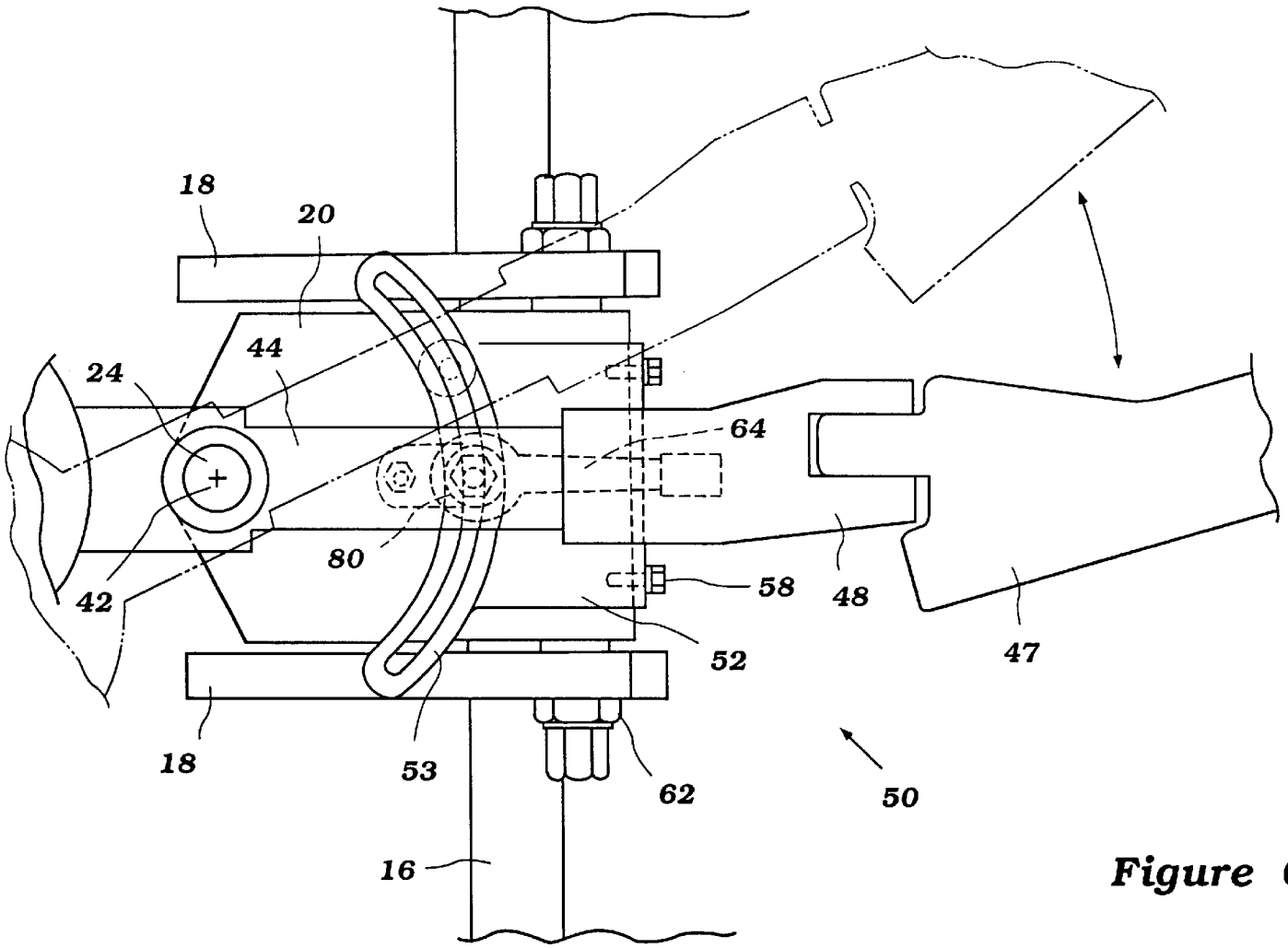
FIG. 6 is a partial top plan view of the swivel bracket and tiller lock of FIG. 1, the movable tiller arm being illustrated in a second position with phantom lines.

As illustrated in FIGS. 4 and 5, the flange 52 has a generally broken L-shape. The flange 52 extends upward and rearward of its mounting location on the clamping bracket to the portion forming the friction track 53. As will be recognized by those of skill in the art, the flange 52 can be either unitary with, or separate from, the friction track 53.

The flange 52 is desirably mounted to the clamping bracket 18 to permit the flange to pivot with the swivel bracket 20 upon tilt and trim movement without any interference by other components of the mounting assembly. In particular, the flange 52 is mounted to a portion of the clamping bracket 18 which is connected to the swivel bracket 20 and the balance of the outboard motor 12. As will be appreciated by those of skill in the art, the flange 52 can also be secured to the swivel bracket or the outboard motor.

Figure 3:
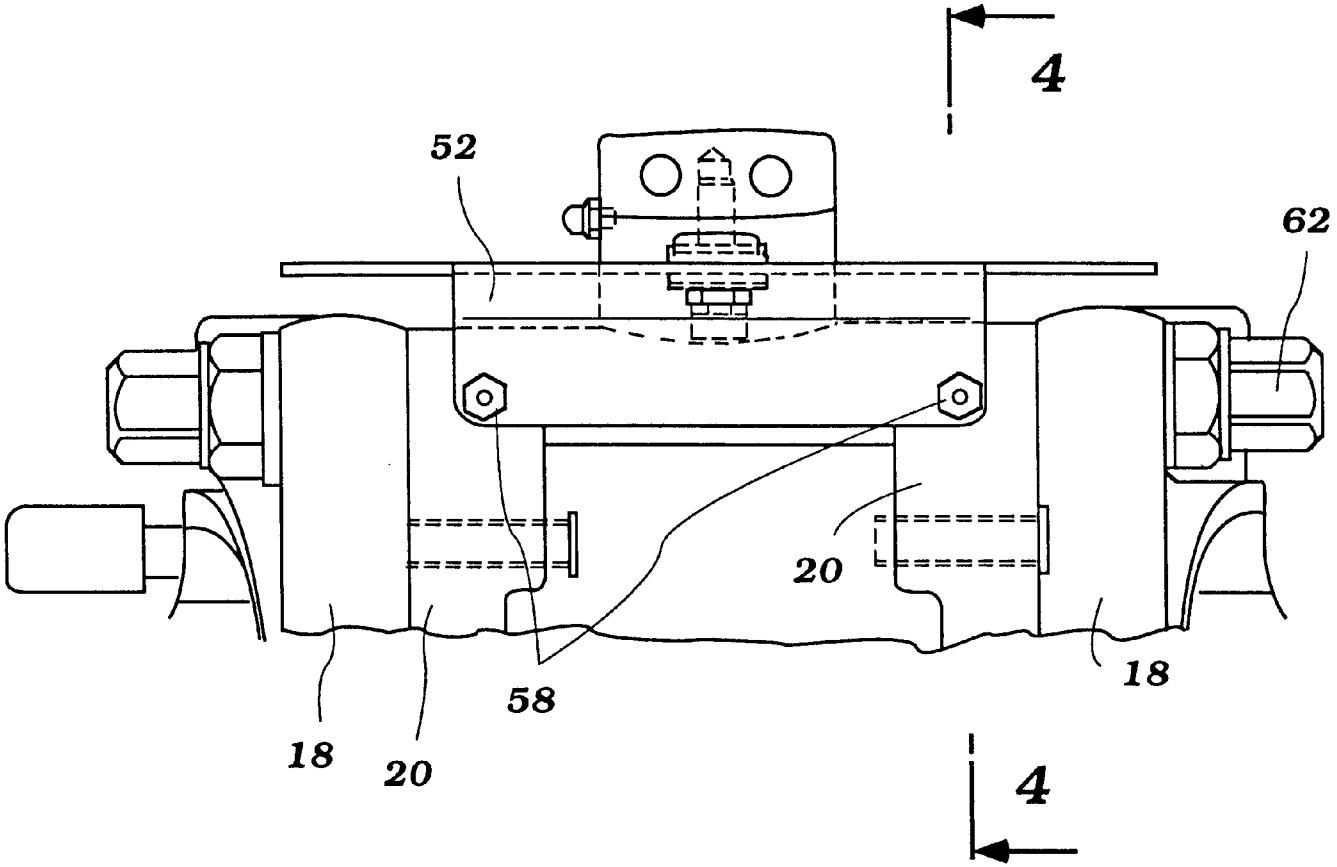
FIG. 3 is a partial front elevational view of the swivel bracket and the tiller lock of FIG. 1.

With reference to FIGS. 2 through 4, the tilt and trim axis 22 of the outboard motor is generally defined by a centerline through the pin 21 which extends through the clamping bracket 18 and the swivel bracket 20. The flange 52 is desirably secured to the swivel bracket 20 at a location forward of a generally vertical plane extending through the tilt and trim axis 22. In the illustrated watercraft, the flange 52 is secured to the clamping bracket 18 by a pair of threaded fasteners 58.

As described above, the flange 52 extends upward and rearward from the secured end to the end proximate the friction track 53. In particular, the flange 52 desirably extends above a plane substantially parallel to an upper surface of the friction track 52 which extends through the tilt and trim axis. Accordingly, the friction track 53 is advantageously arranged rearward of the tilt and trim axis 22 and above the pin 21 and the tilt and trim axis. As will be recognized by one of skill in the art, the flange 52 could also be designed to place the friction track 52 either level with or below the same plane which is parallel to the upper surface of the traction track and extending through the tilt and trim axis 22.

With reference now to FIGS. 4 and 5, the illustrated drag adjustment mechanism 56, which frictionally engages the friction track 53 as described above, is mounted to the tiller 44. Accordingly, as the tiller 44 is rotated about the steering axis 42, the drag adjustment mechanism 56 traces a generally arcuate path which is defined by the arcuate slot 54 of the friction track 53 and/or a radius extending from the steering axis 42 to the drag adjustment mechanism 56.

As best seen in FIG. 5, the drag adjustment mechanism 56 has two opposing braking portions 67 between which the friction track 53 is interposed. An actuating handle 64, which is connected to the tiller 44, is used to deploy either of the two braking portions 67 into engagement with the friction track 53. In particular, when the outboard motor 12 is in a desired steering orientation, the actuating handle 64 is rotated in either a clockwise or counterclockwise direction. The rotation of the actuating handle 64 either raises or lowers the two opposing braking portions 67 as a single unit relative to the friction track 53. Thus, the actuating handle 64 can be rotated in two directions to deploy the braking components. Once deployed, one of the braking portions 67 is urged by the rotation of the actuating handle 64 into frictional engagement with the friction track 53. The compression between the braking portion 67 and the track 53 and the textures of the surfaces create a drag force between the braking portion 67 and the friction track 53. When the actuating handle 64 has been sufficiently rotated, the drag force which results from the increased substantially normal compressive force locks the tiller 44 and the connected outboard motor 12 into the chosen steering position. The actuator handle 64 can subsequently be returned to a neutral central location to remove the drag force and to allow free steering movement of the tiller 44 and the associated outboard motor 12.

As shown in FIG. 5, the illustrated embodiment of the drag adjustment mechanism 56 includes a handle 64 and a hand knob 66. The handle 64 has an oblong slot 68. The hand knob 66 is affixed to a forward portion of the handle in a known manner and provides a gripping portion for the operator of the watercraft.

Figure 7:
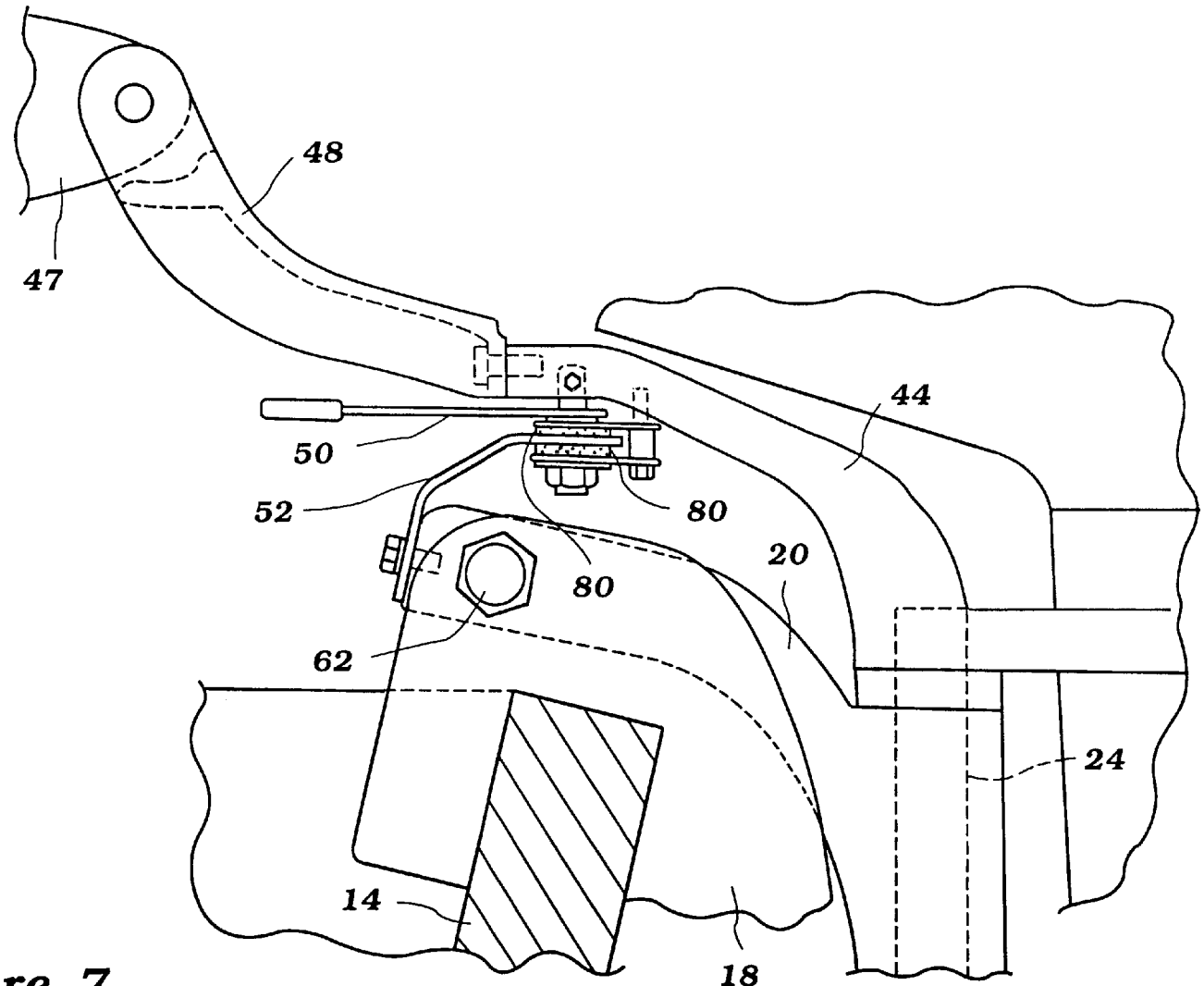
FIG. 7 is a partially sectioned side elevational view of the swivel bracket and the tiller lock of FIG. 1.
Figure 8:
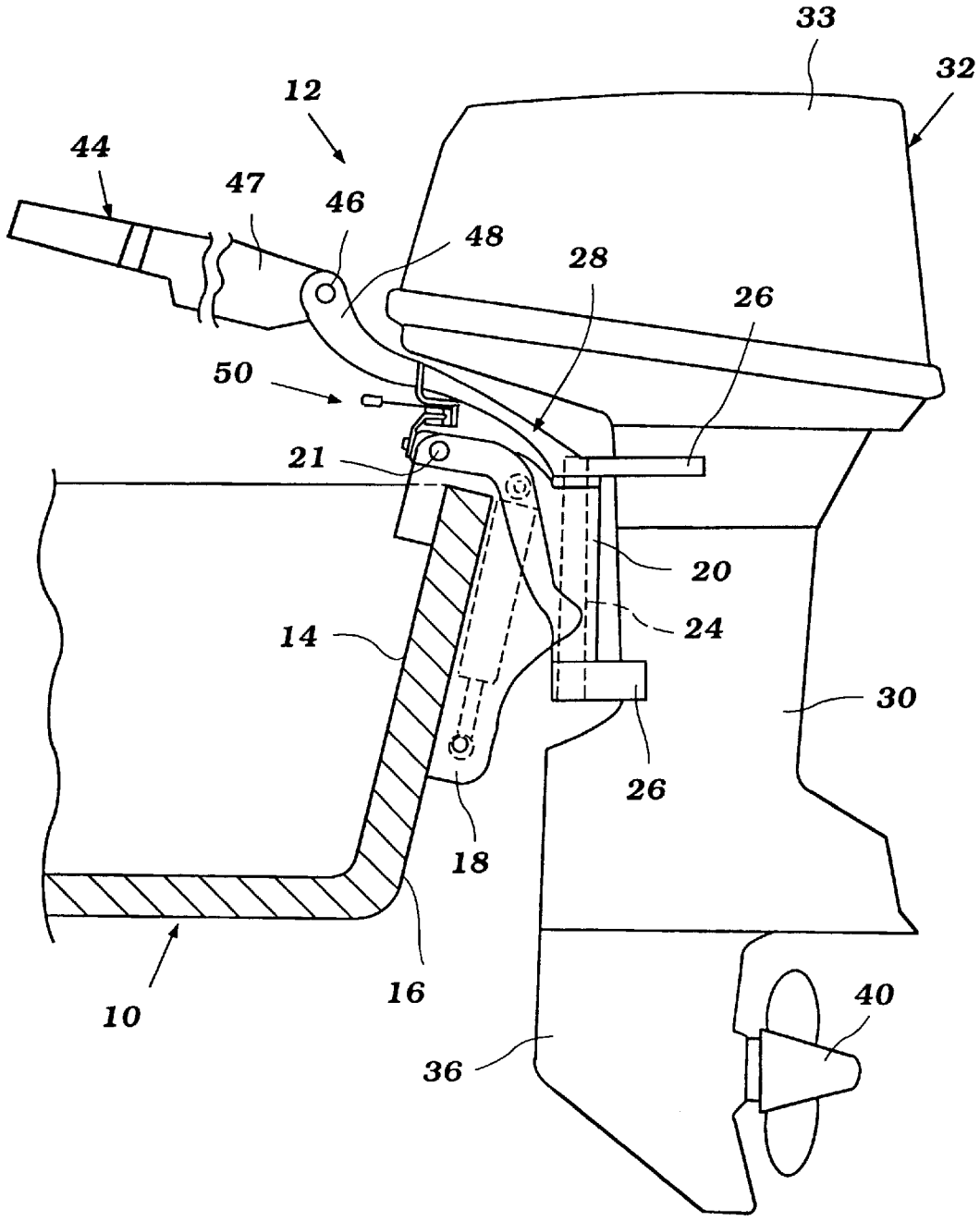
FIG. 8 is a partially sectioned side elevational view of a watercraft having an outboard motor with a swivel bracket and a tiller lock constructed in accordance with another embodiment of the present invention.
Figure 9:
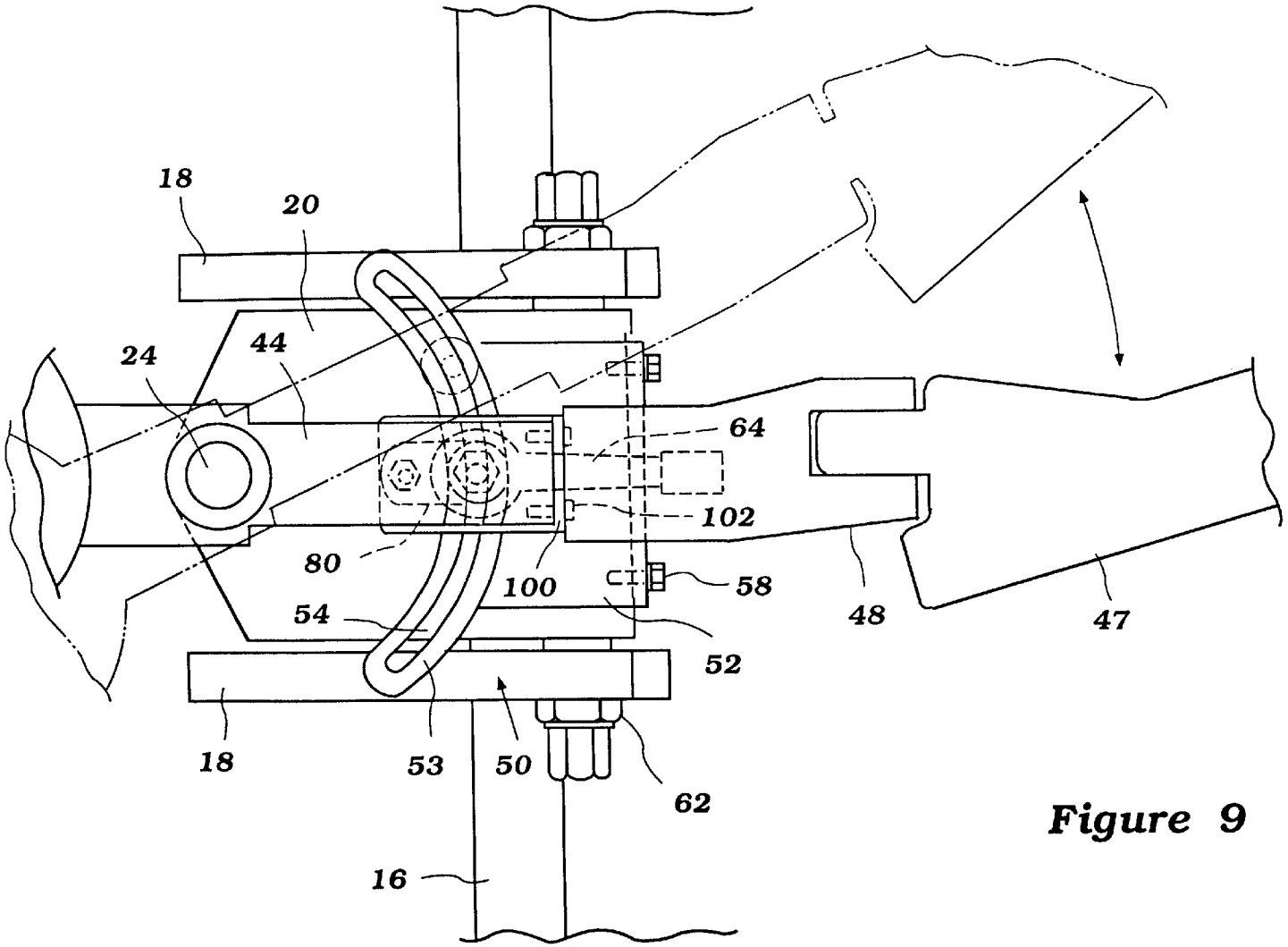
FIG. 9 is a partial top plan view of the swivel bracket and the tiller lock of FIG. 8.
Figure 10:
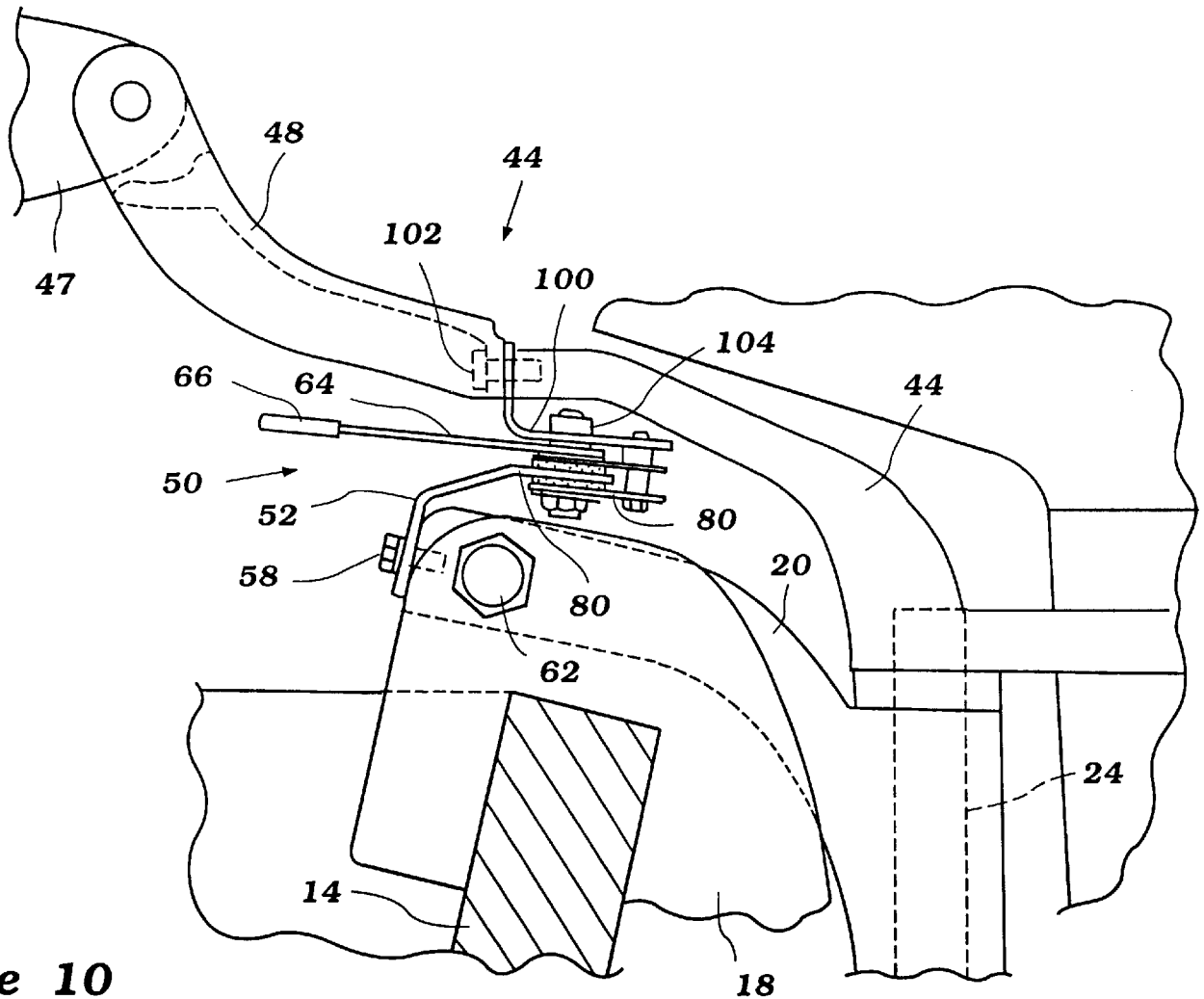
FIG. 10 is an enlarged partially sectioned side view of the swivel bracket and the tiller of FIG. 8.
Figure 11:
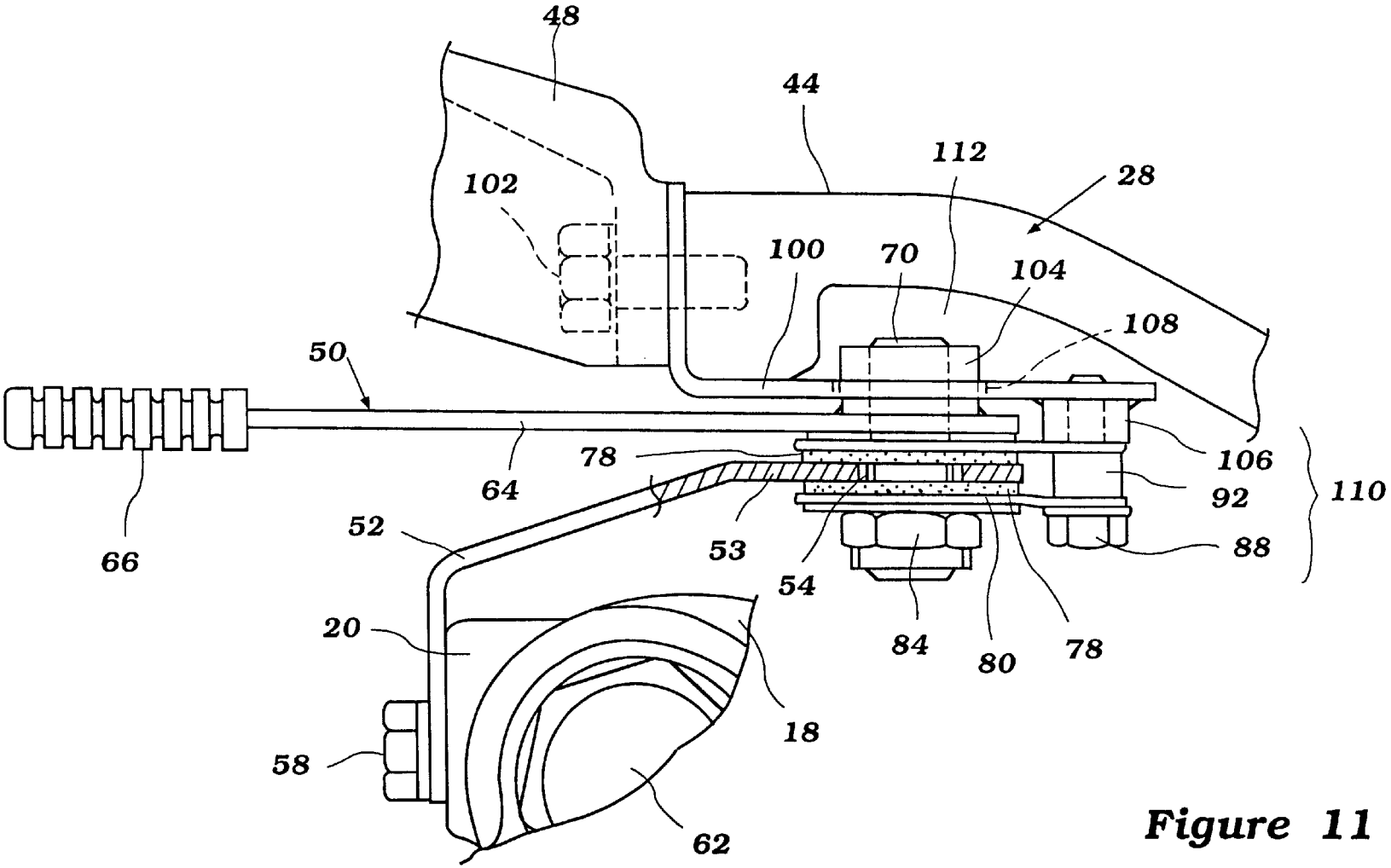
FIG. 11 is a further enlarged partially sectioned side view of the swivel bracket and the tiller lock of FIG. 8.

With reference to FIGS. 4 and 7, the drag adjustment mechanism 56 is secured to the tiller 44 in part by a threaded stub shaft 70 having a pair of substantially parallel flat surfaces. The flat surfaces extend along a length of the shaft. The stub shaft 70 is received in a blind threaded hole 72 of the tiller 44. The blind threaded hole 72 extends in a direction generally normal to the upper surface of the friction track 53. A second hole 74, which is substantially normal to the blind threaded hole, intersects a mid-portion of the threaded hole 72. The second hole 74 is used for the introduction of lubricant. The lubricant, such as grease, enhances the freedom of rotation of the stub shaft 70 within the blind threaded hole 72 of the tiller 44.

A threaded fastener 76 is arranged within the second threaded hole 74. Desirably, the threaded fastener 76 plugs the lubrication hole between lubrications. The second threaded hole advantageously intersects the blind threaded hole 72 in a central region of the threaded portion of the stub shaft 70. As will be appreciated by those of skill in the art, the threaded fastener 76 may be replaced by other known grease plugs, ports or nipples.

Preferably, the brake portions 67 each have an elastic disc-shaped brake pad 78 which is bonded to a corresponding brake plate member 80. As illustrated in FIG. 5, the brake plate members 80 are arranged with the brake pads 78 facing one another. The arcuate friction track 53 is advantageously interposed between the pair of drag brake pads 78.

The illustrated brake plate members 80 have two holes. The two holes each preferably receive a threaded fastener. The stub shaft 70 extends through the first hole 94. The stub shaft thus extends from the tiller 44 through the slotted hole 65 of the handle 64, through a hole 94 in the upper brake plate member 80 and brake pad 78, through the arcuate slot 54 of the flange 52, through the hole 94 in the lower brake pad 78 and brake plate member 80, and through the slotted washer 82 into the nut 84. Thus, the slotted washer 82 and the nut 84, which cooperate with the stub shaft 70, secure one end of the brake plate members 80 to the tiller 44.

The other end of the brake plate members 80 are also secured to the tiller by a second threaded fastener 88 which does not extend through the arcuate slot of the flange 52. As seen in FIG. 5, the second threaded fastener 88 extends through the second hole 86 which is arranged between the rearmost edge of the flange 52 and the steering axis 42. In other words, the rearmost edge of the flange 52 is interposed between the two holes of the braking plate member 80.

The threaded fastener 88 extends through the second holes 86 of both brake plate members and is received by a blind threaded hole 90 in the tiller 44. The brake plate members 80 are spaced apart by a spacer sleeve 92. The spacer sleeve 92 is sized to maintain a desired distance between the two brake plate members 80. The two brake plate members 80 and the spacer sleeve 92 are capable of translation on the second threaded fastener 88.

As a result of this configuration, a rotation of the handle 64 about a turning axis defined through the center of the stub shaft 70 either raises or lowers the entire braking assembly. When placed in a center, neutral position, neither brake pad 78 is in sufficient contact with the friction track 53 to mechanically maintain the steering position of the outboard motor 12. By rotating the handle to one side or the other, both brake plate numbers 80 are either raised or lowered as a single unit. By raising or lowering both brake plate members 80, only one of the brake pads 78 is urged against the friction track 53. Consequently, a drag friction force sufficient to lock the position of the tiller is created between one of the brake pads 78 and the friction track 53. As will be recognized by one of skill in the art, the geometry of the threads of the stub shaft 70 and the blind hole 72 control the degree of angular rotation of the handle necessary to create a sufficient normal loading between the brake pad 78 and the friction track 53 to enable the drag friction force to maintain the position of the outboard motor 12 relative to the watercraft 10. In addition, the lubrication port 74 allows the threads of the stub shaft 70 and the blind threaded hole 72 to be periodically lubricated to maintain a freedom of motion and prevent accidental seizing of the components.

The tiller locking device 50 thus provides an adjustable drag friction arrangement which permits a watercraft operator to readjust the positioning of the motor 12 relative to the watercraft 10 from one selected fixed position to another. The readjustment is accomplished by decreasing the frictional drag between a drag brake and a drag plate by retracting the drag brake from the drag plate, applying a turning force to the tiller 44 to readjust the position of the motor 12 relative to the watercraft and then returning the drag brake into contact with the drag plate to create a frictional drag force sufficient to hold the motor 12 in its desired position. Thus, the tiller locking device 50 can be easily released to allow the watercraft operator to readjust the orientation of the motor relative to the watercraft 10. In addition, the tiller locking device 50 can be quickly and easily locked in a selected position to allow the watercraft 10 to continue along a corresponding predetermined tack without the further aid of the watercraft operator, thereby freeing the hands of the operator for other activities.

Accordingly, if the operator desires to maintain the motor 12 in a particular straight-ahead or turning tack, the operator can engage the tiller locking device 50 by turning the handle 64 on the drag adjustment mechanism 56 (as shown by the phantom lines in FIG. 2) a sufficient angular rotation to urge either the upper or lower brake pad into engagement with the arcuate friction track 53. Depending on the direction of rotation, the compression adjustment mechanism 56 will urge either the upper or lower brake pad into dragging engagement with the arcuate friction track 53. The frictional engagement between the two surfaces will hold the motor 12, and specifically the power head 32 and drive shaft housing 30, against steering rotation about the steering shaft 24 under normal loads. The normal loading is typically due to engine vibration and water resistance when traveling in a straight or turning tack.

The present tiller locking device 50, therefore, conveniently permits a motor 12 to be retained in a plurality of selectable steering positions without the operator maintaining a hand on the tiller 44. Moreover, the device 50 conveniently permits the operator to readjust the motor 12 from an initial retained tack to any other retained tack by releasing the described drag adjustment mechanism 56 and applying a horizontal force to the tiller 44. It also should be readily apparent from the foregoing description that the tiller locking device 50 is designed to pivot up and down with the swivel bracket 20 about the tilt axis 22. For instance, when the motor 12 is rotated upward so as to be out of the water, the tiller locking device 50 is still capable of maintaining a selected positioning of the outboard motor 12 relative to the watercraft 10 as described above.

In addition, the inventive positioning of the friction track 53 and the drag adjustment mechanism 56 at least partially rearward of the pin 21 protects the key components of the tiller locking device 50 during any tilting movement of the outboard motor. In particular, the location of the friction track 53 allows the outboard motor 12 to be freely trimmed or tilted without fear of damaging the friction track 53. Because the friction track 53 is located at least partially behind the pivot pin 21, the position of the flange 52 and the friction track 53 are restricted to a range into which other components of the outboard motor mounting assembly do not encroach. Thus, even when the outboard motor 12 is fully tilted such that the propeller 40 is above the waterline 38, the friction track 53 and the related drag adjustment mechanism 56 are protected from damage caused by contact with other components of the outboard motor mounting assembly, such as the transom screw 19. Accordingly, the inventive location of the drag adjustment mechanism 56 and the friction track 53 protect them throughout the range of motion of the motor 12 relative to the watercraft 10.

With reference now to FIGS. 8–11, another embodiment of an outboard motor mounting arrangement is illustrated therein. As illustrated, this motor mounting arrangement differs from the embodiment illustrated in FIGS. 1–7 in that the tiller locking device 50 is supported via a bracket from the tiller 44 of the outboard motor 12.

The bracket indicated generally by the reference numeral 100 is connected to the tiller 44 in any suitable manner. The illustrated bracket is formed in an L configuration having a first arm extending in a first direction and a second arm extending in a direction generally normal to the first direction. The bracket 100 is preferably positioned between two portions of the tiller and supported therein via threaded fasteners 102.

As illustrated, the bracket 100 may be sandwiched between the base portion of the tiller 44 and the arc-shaped member 48. In this configuration, the first arm is sandwiched between the two members 44, 48, while the second arm of the bracket 100 extends in a direction generally parallel to the portion of the flange 52 that carries the friction track 53. In this manner, the locking device 50 may be attached to the bracket 100 with a nut 104 and a weld nut 106. The nut 104 and the weld nut 106 in the illustrated embodiment allow the locking device 50 to be attached to the bracket 100 rather than being fastened to the base portion of the tiller 44 or any other portion of the tiller body itself. In the illustrated embodiment, the nut 104 is preferably a weld nut that is attached to the actuator arm 64 and passes through a hole 108 within the bracket 100. In this manner, the locking assembly 50 is held to the bracket 100 with the assembly 110 while the portion of the locking assembly 50 that passes through the slot 54 is free to translate in a generally vertical direction with reference to FIG. 11.

Additionally, the locking portion of the locking mechanism 50 is desirably positioned along the tiller 44 at a location featuring a recess 112 such that the moving portions of the assembly 50 are generally shielded from the environment while in use. More preferably, the locking portion of the locking mechanism 50 is positioned rearward of a generally vertical transverse plane extending though the watercraft transom.

The configuration illustrated in FIGS. 8–11 advantageously eases assembly of the locking device by allowing the locking device 50 to be quickly and easily bolted into place during manufacture or maintenance. Specifically, because the bolts 58 and 102 both extend in a forward direction, the bolts may be attached and tightened without having to manipulate tools into cramped spaces. Additionally, because the locking assembly 50 is easily slid into position at a late stage in the assembly of the outboard motor 12, the locking assembly 50 may be positioned after the final finishing paint job has been completed on the outboard motor 12 thereby reducing the risk of paint falling on the friction board 53. Such paint stains would likely reduce the effect of the friction board thereby making it more difficult to effectively lock the steering assembly from movement. Furthermore, when maintenance of the locking device 50 is required, only the forward portion of the tiller 44 need be removed to effect removal of the entire device 50. Therefore, access and maintenance to the device 50 is greatly increased in this motor mounting arrangement of FIGS. 8–11.

Although this invention has been described in terms of a certain embodiment, other embodiments apparent to those of ordinary skill in the art also are within the scope of this invention. Accordingly, the scope of the present invention is intended to be defined only by the claims that follow.

What is claimed is:

1. An outboard motor comprising a clamping bracket adapted to be attached to a watercraft, a pin connecting a swivel bracket to the clamping bracket, the swivel bracket being pivotal for a tilting movement relative to the clamping bracket about a substantially horizontal tilt and trim axis, the swivel bracket also enabling a steering movement of the outboard motor relative to the watercraft about a steering axis that is substantially normal to the tilt and trim axis, a tiller attached to the outboard motor to facilitate the steering movement, the tiller extending forwardly of the steering axis, a tiller locking device operable between the swivel bracket and the tiller, the tiller locking device comprising a moveable member, the moveable member being moveable between a locked position and an unlocked position, the tiller locking device arranged at least partially rearward of the pin, and an actuator coupled to the moveable member in a manner permitting selective movement of the moveable member from the unlocked position to the locked position.

2. The outboard motor of claim 1 wherein the tiller locking device has a friction track which is arranged at least partially rearward of the tilt and trim axis.

3. The outboard motor of claim 1 wherein the friction track is arranged above a plane extending parallel to a top surface of the friction track and through the tilt and trim axis.

4. The outboard motor of claim 3, wherein the top surface of the friction track frictionally engages a braking member.

5. The outboard motor of claim 1 further comprising a mounting bracket positioned between the tiller locking device and the tiller.

6. The outboard motor of claim 1 wherein the actuator comprises a handle, the handle having a length which is less than a distance defined between the friction track and a transom screw of the clamping bracket.

7. The outboard motor of claim 1, wherein the tiller locking device has a friction track which is arranged entirely rearward of the tilt and trim axis.

8. The outboard motor of claim 1, wherein the actuator comprises a handle, at least a portion of the handle extending forward of the friction track.

9. The outboard motor of claim 8, wherein the length of the handle extending forward of the tilt and trim axis is shorter than a distance defined between the tilt and trim axis and a transom screw of the clamping bracket.

10. An outboard motor comprising a clamping bracket adapted to be attached to a watercraft, a pin connecting a swivel bracket to the clamping bracket, the swivel bracket being pivotal for a tilting movement relative to the clamping bracket about a substantially horizontal tilt and trim axis, the swivel bracket also enabling a steering movement of the outboard motor relative to the watercraft about a steering axis that is substantially normal to the tilt and trim axis, a tiller attached to the outboard motor to facilitate the steering movement, the tiller extending forwardly of the steering axis, a tiller locking device comprising a friction track, the tiller locking device operable between the swivel bracket and the tiller, the tiller locking device arranged at least partially rearward of the pin, and the friction track is arranged entirely rearward of the tilt and trim axis.

11. The outboard motor of claim 10, wherein the friction track is arranged above a plane extending parallel to a top surface of the friction track and through the tilt and trim axis.

12. The outboard motor of claim 11, wherein the top surface of the friction track is frictionally engaged by a braking member.

13. The outboard motor of claim 10, wherein the tiller locking device has a forwardly extending handle, the handle having a length which is less than a distance defined between the friction track and a transom screw of the clamping bracket.

14. The outboard motor of claim 10 further comprising a mounting bracket supported by the tiller and supporting the tiller locking device.

15. An outboard motor mounting assembly comprising a swivel bracket pivotally attached to a clamping bracket by a pin, the swivel bracket rotatable relative to the clamping bracket about a substantially horizontal tilt and trim axis, a steering shaft journalled by the swivel bracket for movement of the steering shaft relative to the swivel bracket about a steering axis which is substantially normal to the tilt and trim axis, a tiller arm connected to the steering shaft for controlling the movement of the steering shaft, a locking mechanism operable between the swivel bracket and steering shaft so as to selectively maintain the position of the steering shaft relative to the swivel bracket, the locking mechanism arranged to lie at least partially rearward of a substantially vertical plane defined through the pin, the locking mechanism comprising a first member, the first member moveable between an engaged position and a disengaged position, and an actuator coupled to the locking mechanism in a manner permitting selective movement of the first member from the disengaged position to the engaged position.

16. The outboard motor mounting assembly of claim 15, wherein, at least a portion of the actuator extends forward of the substantially vertical plane.

17. The outboard motor mounting assembly of claim 15, wherein the locking mechanism further comprises a friction track which is arranged to lie entirely rearward of the substantially vertical plane.

18. The outboard motor mounting assembly of claim 17, wherein the friction track is arranged to lie partially above a plane which extends through the tilt and trim axis and is substantially parallel to an upper surface of the friction track.

19. The motor mounting assembly of claim 18, wherein the upper surface is frictionally engaged by a braking member.

20. The outboard motor mounting assembly of claim 17, wherein the friction track has an arcuate slot.

21. The outboard motor mounting assembly of claim 17, wherein the friction track is connected to the swivel bracket at a location forward of the friction track.

22. The outboard motor mounting assembly of claim 15, wherein the locking mechanism comprises a friction track that is interposed between a pair of braking members, the braking members being selectively and individually engageable with the friction track.

23. The outboard motor mounting assembly of claim 22, wherein the braking members are connected to a bi-directional actuating member.

24. The outboard motor mounting assembly of claim 15 further comprising a locking mechanism support bracket that connects the locking mechanism to the tiller arm.

25. An outboard motor comprising a powerhead connected by a driveshaft housing to a propulsion unit, the driveshaft housing connected to a steering shaft, the steering shaft journalled by a swivel bracket for rotational movement, the swivel bracket attached to a clamping bracket, the clamping bracket having a transom screw, the swivel bracket pivotal relative to the clamping bracket about a substantially horizontal tilt and trim axis, a locking mechanism operable between the swivel bracket and a tiller for securing the relative position between the swivel bracket and the tiller, the locking mechanism having a friction track interposed between at least two braking members, and the braking members being alternately engageable with the friction track.

26. The outboard motor of claim 25, wherein the locking mechanism is positioned at least partially rearward of a substantially vertical plane extending through the tilt and trim axis.

27. The outboard motor of claim 25, wherein the locking mechanism is positioned entirely rearward of the substantially vertical plane.

28. The outboard motor of claim 26, wherein the locking mechanism is actuated by a handle which extends forward of the substantially vertical plane.

29. The outboard motor of claim 28, wherein the handle may be pivoted in two directions to actuate the locking mechanism.

30. The outboard motor of claim 28, wherein the handle has a length less than a length defined between an upper most portion of the transom screw and a lower surface of the tiller arm.

31. The outboard motor of claim 25, wherein the two braking members have a first position relative to one another, the two braking members being adjustable to a second position relative to one another to enable adjustment of a frictional force present between an engaged braking member and the friction track due to decreases in the frictional force resulting from use.

32. The outboard motor of claim 25 further comprising a mounting bracket connecting the locking mechanism to the tiller.

* * * * *